US008687998B2

(12) United States Patent
Akagawa et al.

(10) Patent No.: US 8,687,998 B2
(45) Date of Patent: Apr. 1, 2014

(54) IMAGE FORMING APPARATUS

(71) Applicant: Sharp Kabushiki Kaisha, Osaka (JP)

(72) Inventors: Yuhi Akagawa, Osaka (JP); Shinji Sugita, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 0 days.

(21) Appl. No.: 13/963,637

(22) Filed: Aug. 9, 2013

(65) Prior Publication Data

US 2013/0322914 A1 Dec. 5, 2013

Related U.S. Application Data

(63) Continuation of application No. 13/015,788, filed on Jan. 28, 2011, now Pat. No. 8,509,647.

(30) Foreign Application Priority Data

Jan. 29, 2010 (JP) ..... 2010-018873

(51) Int. Cl.
*G03G 21/20* (2006.01)
*G03G 21/00* (2006.01)

(52) U.S. Cl.
USPC ..... 399/92; 399/93; 399/98

(58) Field of Classification Search
USPC ..... 399/92, 93, 98
See application file for complete search history.

(56) References Cited

U.S. PATENT DOCUMENTS

| | | | |
|---|---|---|---|
| 5,128,720 | A | 7/1992 | Creveling |
| 5,438,390 | A | 8/1995 | Kobayashi et al. |
| 6,463,236 | B2 | 10/2002 | Morikami et al. |
| 6,522,847 | B2 | 2/2003 | Nanjo |
| 7,433,624 | B2 | 10/2008 | Ohkura |
| 2001/0026702 | A1 | 10/2001 | Nanjo |
| 2003/0165345 | A1 | 9/2003 | Chikano |
| 2004/0062564 | A1 | 4/2004 | Chikano |
| 2006/0120748 | A1 | 6/2006 | Takehara et al. |
| 2007/0003314 | A1 | 1/2007 | Shuto |
| 2008/0219695 | A1 | 9/2008 | Doshohda |
| 2011/0142482 | A1 | 6/2011 | Nakashima |

FOREIGN PATENT DOCUMENTS

| | | |
|---|---|---|
| JP | 04-334156 | 11/1992 |
| JP | 2003-254556 | 9/2003 |
| JP | 2004-233618 | 8/2004 |
| JP | 2005-004144 | 1/2005 |
| JP | 2008-250284 | 10/2008 |

OTHER PUBLICATIONS

Office Action Issued in U.S. Appl. No. 13/015,788 on Oct. 25, 2012.
Notice of Allowance Issued in U.S. Appl. No. 13/015,788 on Apr. 25, 2013.

*Primary Examiner* — Walter L Lindsay, Jr.
*Assistant Examiner* — David Bolduc
(74) *Attorney, Agent, or Firm* — Nixon & Vanderhye P.C.

(57) ABSTRACT

An image forming apparatus includes an image forming section, a paper supply section, a housing member and an ion generating unit. The housing member is disposed at least below the image forming section, and gives the same shape in plane view as the image forming section and the paper supply section. The ion generating unit is contained in the housing member. The ion generating unit includes a duct forming a pathway of flow to guide the air that is sucked in from outside of the housing member again to outside of the housing member, an ion generating device disposed inside the duct, and a fan for generating an air current in the duct.

12 Claims, 10 Drawing Sheets

IMAGE FORMING APPARATUS

CROSS REFERENCE

This application is a continuation of U.S. application Ser. No. 13/015,788, which was filed on Jan. 28, 2011, and which issued as U.S. Pat. No. 8,509,647 on Aug. 13, 2013, the entire contents of which is hereby incorporated by reference. This application also claims priority, under 35 U.S.C. §119(a), to the filing date of Japanese Patent Application No. 2010-018873, which was filed in Japan on Jan. 29, 2010, the entire contents of which is also hereby incorporated by reference.

BACKGROUND OF THE INVENTION

The present invention relates to an image forming apparatus equipped with an ion generating unit having an ion generating function.

It is no exaggeration to say that an image forming apparatus such as a copier or a printer is an essential device in office; in fact, they are installed in most offices. Besides, in recent years, image forming apparatus are also spreading in ordinary households and hospitals, and have become an article very close to us.

By the way, among the image forming apparatus are such ones that suck air from surroundings of the image forming apparatus into the interior of its housing, supply the air to its image forming section and fuser section, and then exhaust the air outside the image forming apparatus. Among such image forming apparatus, as described in Japanese Patent Unexamined Publication No. 2005-4144 bulletin, there is an image forming apparatus comprising an air cleaning section configured so as to prevent hazardous substances that are generated inside the apparatus from being emitted outside the apparatus, by removing hazardous substances contained in an air current to be released outside the apparatus and thus cleaning the air current, and then by supplying negative ions.

In the technique as described in the Japanese Patent Unexamined Publication No. 2005-4144 bulletin, in order to meet the need for removing toner powder, dust, ozone and the like that are occurring with the image forming operation of the image forming section, it is unavoidable to dispose an ion generating section with an electrode in the proximity of the image forming section and in the air current that is formed around the image forming section. In a fuser section included in the image forming section, silicon is used as a release agent of paper. As a result, the efficiency of generating ions of the ion generating section deteriorates due to an influence of such as silicon and/or the like generated around the image forming section; accordingly, there has been a problem that the capability to clean the air around the image forming apparatus deteriorates as a period of service of the image forming apparatus gets longer.

On the other hand, it is conceivable that deterioration in efficiency of generating ions will be prevented by taking a large distance between the ion generating section and the image forming section. Nevertheless, in a case where a unit provided with an air cleaning function is disposed adjacent to a side face, a rear face or a front face of the main body of the image forming apparatus so as to take a large distance between the ion generating section and the image forming section, extra space becomes necessary for installing such a unit; in consequence, there has been a problem that the space required for installing such an image forming apparatus increases.

The present invention is directed to providing an image forming apparatus capable of performing a stable generation of ions for an extended period of time, without increasing the floor space required for its installation.

SUMMARY OF THE INVENTION

An image forming apparatus comprises an image forming section, a paper supply section, a housing member, and an ion generating unit. The image forming section performs an image forming process on paper. The paper supply section contains paper to be supplied to the image forming section. The housing member is disposed at least below the image forming section, and gives the same shape in plane view as the image forming section and the paper supply section. The ion generating unit is contained inside the housing member. The ion generating unit includes a duct forming a pathway of flow guiding the air that is sucked in from outside of the housing member again to outside of the housing member, an ion generating device disposed in the duct, and an air current generating section for generating an air current in the duct.

With this configuration, since the housing member containing an ion generating unit is disposed below the image forming section and gives the same shape in plane view as the image forming section and the paper supply section, the housing member does not protrude outward as compared with the image forming section and the paper supply section. Therefore, in order to install the housing member, more floor space than required to install the image forming section and the paper supply section becomes unnecessary. Moreover, since the ion generating device is disposed inside the duct that is opening at both ends to outside of the housing member, and thus being disposed in a space isolated from the space where the image forming section belongs to, influence of silicon or the like, which is generated from the image forming section, on the ion generating device is prevented.

According to the present invention, a stable generation of ions for an extended period of time is enabled without increasing the floor space required for an installation.

DETAILED DESCRIPTION OF THE INVENTION

Figure 1:
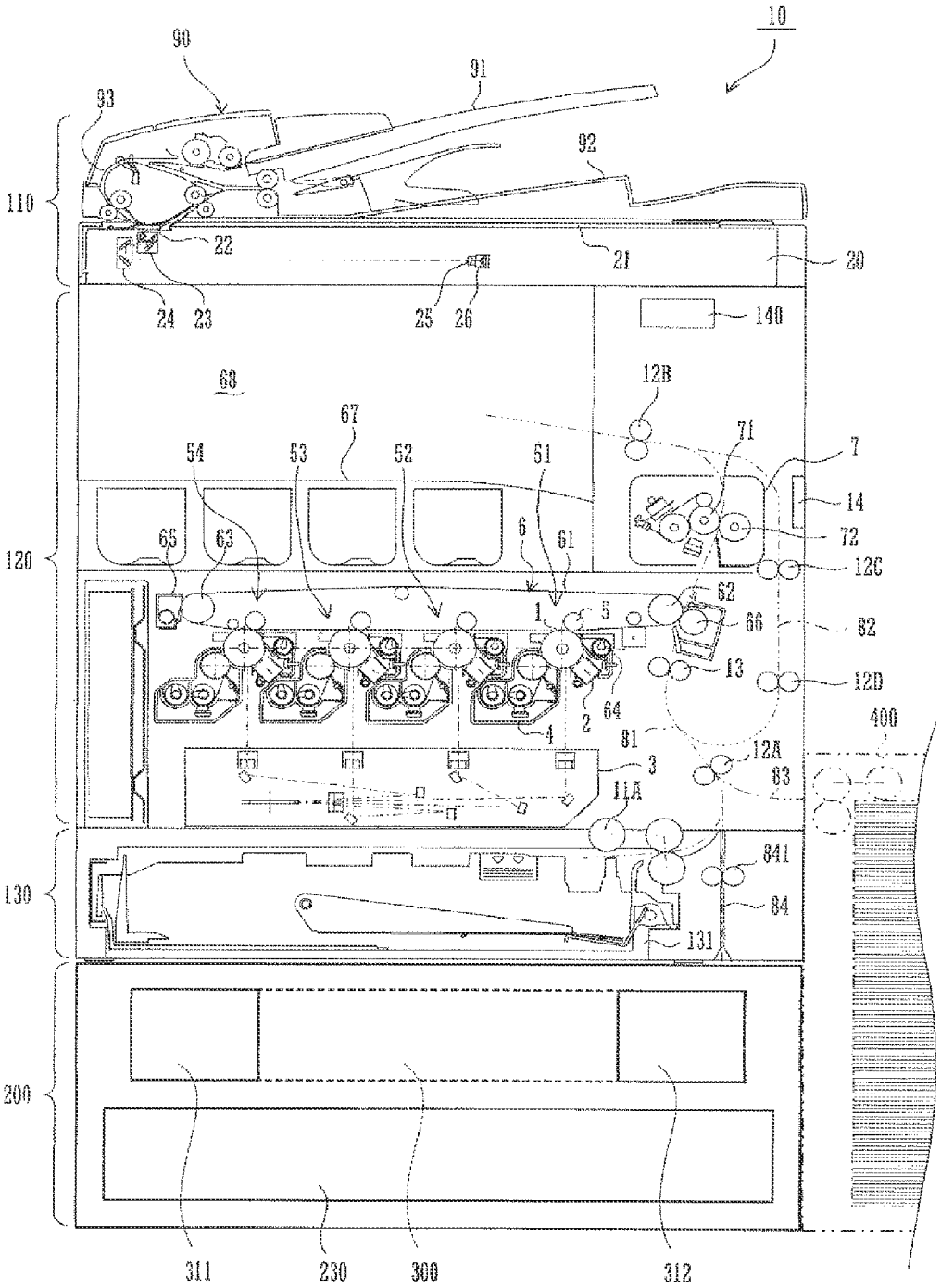
FIG. 1 is a drawing showing an outline of a configuration of an image forming apparatus according to an embodiment of the present invention.

Referring to the drawings, embodiments of the present invention are explained below.

As shown in FIG. 1, an image forming apparatus 10 comprises an image reading section 110, an image forming section 120, a paper supply section 130, a housing member 200, an ion generating unit 300 and a control section 140.

The image reading section 110 is provided with an automatic document feeder (ADF) 90 and a scanner unit 20.

The scanner unit 20 is provided with a first document table 21, a second document table 22, a light source unit 23, a mirror unit 24, a lens 25 and a solid-state image sensing device (CCD: Charge Coupled Device) 26, and performs an image reading process in which an image of a document is read and image data thereof is generated.

The ADF 90 is provided with a document load tray 91, a document output tray 92, and a document conveying path 93 that is extending from the document load tray 91 to the document output tray 92 via the second document table 22.

The ADF 90 conveys documents to the document conveying path 93 piece by piece. The ADF 90, in order to jacket a top surface of the first document table 21 in such a manner as to open and shut thereof freely, is configured so as to swing freely around a supporting point at an edge of its rear face side, that is, the opposite side of its front face side. By swinging the ADF 90 so that the edge of the front face side thereof moves upward and thereby causing the top surface of the first document table 21 to be exposed to outside, document can be placed on the first document table 21 by manual operation without using the ADF 90. Both the first document table 21 and the second document table 22 are made of rigid sheet glass.

The light source unit 23 and the mirror unit 24 are caused to move freely in a secondary scanning direction along the first document table 21 and the second document table 22 under the first document table 21 and the second document table 22.

Traveling rate of the mirror unit 24 is half the traveling rate of the light source unit 23. The light source unit 23 is equipped with a light source and a first mirror. The mirror unit 24 is equipped with a second mirror and a third mirror.

In a moving document reading formula in which an image of a document conveyed by the ADF 90 is read, the light source unit 23 is stationary under the second document table 22. The light of the light source is irradiated to an image plane of the document that is passing on the second document table 22, and the light reflected by the image plane of the document is led to the mirror unit 24 by the first mirror.

In a stationary document reading formula in which an image of a document that is placed on the first document table 21 is read, both the light source unit 23 and the mirror unit 24 move toward the secondary scanning direction under the first document table 21. The light of the light source is irradiated to an image plane of the document placed on the first document table 21, and the light reflected by the image plane of the document is led to the mirror unit 24 by the first mirror.

Regardless of whether the ADF 90 is used or not, the light reflected by the image plane of the documents is led to the second mirror and the third mirror with an identical optical path length, and then incident on the CCD 26 via the lens 25.

The CCD 26 outputs an electrical signal depending on a light quantity of the light reflected by the image plane of the document. The electrical signal is inputted to the control section 140 as image data. In this manner, the image reading section 110 reads the image of the document and then generates the image data. The control section 140 outputs the image data to the image forming section 120 where necessary.

The image forming section 120 is disposed under the image reading section 110. The image forming section 120 is in a part thereof made to have a smaller cross section in a horizontal direction than the image reading section 110 so as to provide, under the image reading section 110, a space 68 for installing a paper discharge tray 67 to receive paper that is finished with an image forming process. In this manner, the image forming apparatus 10 gives a so-called intra-body discharge geometry. As the paper, recording media such as plain paper, photographic paper and OHP film are given.

The image forming section 120 comprises an exposure unit 3, four image forming stations 51, 52, 53, 54, an intermediate transcription belt unit 6, a secondary transcription roller 66, a fuser 7, a paper discharge tray 67, a first paper conveying path 81 and a second paper conveying path 82, and performs an image forming process on the paper based on the image data.

The intermediate transcription belt unit 6 includes an intermediate transcription belt 61, a drive roller 62, a compliance roller 63 and a tension roller. The intermediate transcription belt 61 is stretched in a tensioned condition between the drive roller 62 and the compliance roller 63, and forms a loop-like path of movement.

The image forming section 120 performs image forming processes at the image forming stations 51, 52, 53, 54 using the image data corresponding to respective hues of four colors consisting of black and three primary colors of subtractive mixture derived from the color separation of a colored image; that is, cyan, magenta and yellow. The image forming stations 51-54 are arranged in a single row along a direction of movement of the intermediate transcription belt 61. The image forming stations 52-54 are configured substantially in the same manner as the image forming station 51.

The image forming station 51 for black includes a photoreceptor drum 1, an electrifying device 2, a developing device 4, a primary transcription roller 5 and a cleaning unit 64.

The electrifying device 2 charges a surface of the photoreceptor drum 1 uniformly at a predetermined electrostatic potential.

The exposure unit 3 is provided with a semiconductor laser, a polygon mirror, a first fθ lens and a second fθ lens, which are not shown, and irradiates respective laser beams modulated by the image data of respective hues consisting of black, cyan, magenta and yellow to the respective photoreceptor drums 1 of the image forming stations 51-54. On respective circumferential surfaces of the four photoreceptor drums 1, electrostatic latent images are formed depending on the image data of the respective hues of black, cyan, magenta and yellow.

The developing device 4 supplies toners (developers) of respective hues of the image forming stations 51-54 to the circumferential surfaces of the photoreceptor drums 1 on which the electrostatic latent images have been formed, and then renders the electrostatic latent images visible in developer images.

The cleaning unit 64 collects the toners remaining on the surfaces of the photoreceptor drums 1 after the development and image transcription.

An outer circumferential surface of the intermediate transcription belt 61 faces the four photoreceptor drums 1 sequentially. At respective positions facing the respective photoreceptor drums 1 across the intermediate transcription belt 61 are disposed the primary transcription rollers 5. Respective positions at which the intermediate transcription belt 61 and the photoreceptor drums 1 face each other are the primary transcription positions.

To the primary transcription rollers 5, in order to transcribe the developer images borne by the circumferential surfaces of the photoreceptor drums 1 onto the intermediate transcription belt 61, a primary transcription bias of reverse polarity (e.g., plus) to the electrostatic charge polarity (e.g., minus) of the toner is applied by a constant voltage control. Thereby, the developer images of the respective hues formed on the respective photoreceptor drums 1 are transcribed (primary transcription) through a sequential superimposition onto the outer circumferential surface of the intermediate transcription belt 61; and thus a full-colored developer image is formed on the outer circumferential surface of the intermediate transcription belt 61.

Nevertheless, when image data of only a part of hues of yellow, magenta, cyan and black are inputted, formation of the electrostatic latent images and developer images is performed at only the part of the four photoreceptor drums 1 corresponding to the hues of the inputted image data. For instance, in monochromatic printing mode, formation of the electrostatic latent image and formation of the developer image are performed only at the photoreceptor drum 1 of the image forming station 51 corresponding to the hue of black, and then a primary transcription of only a black developer image is performed onto the outer circumferential surface of the intermediate transcription belt 61.

In full-colored image forming where image forming processes are carried out at all the image forming stations 51-54, the four primary transcription rollers 5 cause the intermediate transcription belt 61 to contact with pressure all the photoreceptor drums 1. On the other hand, in monochromatic image forming where an image forming process is carried out only at the image forming station 51, the primary transcription roller 5 causes the intermediate transcription belt 61 to contact with pressure the photoreceptor drum 1 only at the image forming station 51.

Each of the primary transcription rollers 5 applies a high voltage to the intermediate transcription belt 61 uniformly. The secondary transcription roller 66, across the intermediate transcription belt 61, contacts the drive roller 62 with a predetermined nip pressure. The secondary transcription roller 66 transcribes (secondary transcription) the developer image borne on the outer circumferential surface of the intermediate transcription belt 61 onto the paper.

The developer images that have been transcribed on the outer circumferential surface of the intermediate transcription belt 61 at the respective primary transcription positions are conveyed, through a rotation of the intermediate transcription belt 61, to the secondary transcription position at which the intermediate transcription belt 61 and the secondary transcription roller 66 face each other.

The paper supply section 130 is disposed below the image forming section 120. In this embodiment, the paper supply section 130 is disposed between the image forming section 120 and the housing member 200.

The paper supply section 130 is provided with a paper cassette 131. The paper cassette 131 contains the paper to be supplied to the image forming section 120. The first paper conveying path 81 is installed extending from the paper cassette 131 to the paper discharge tray 67 via the secondary transcription position and the fuser 7. In the first paper conveying path 81 are disposed a plurality of conveyance rollers 12A, 12B. The paper contained in the paper cassette 131 is fed to the first paper conveying path 81 piece by piece by a pickup roller 11A, and then conveyed to the secondary transcription position.

The second paper conveying path 82 is disposed between the limits extending from a downstream side of the fuser 7 to an upstream side of the secondary transcription position in a paper conveying direction. In the second paper conveying path 82 are disposed a plurality of conveyance rollers 12C, 12D. To the second paper conveying path 82, the paper discharged to the paper discharge tray 67 after having passed the fuser 7 is conveyed with its former back to front. Thereby, the paper is supplied again to the secondary transcription position with its former front and back faces reversed.

Besides, on the upstream side of the secondary transcription position, the first paper conveying path 81 is joined by a third paper conveying path 83 that is open on one side face of the image forming section 120. In a case where a high capacity paper feeder 400 is disposed adjacent to the one side face of the image forming section 120, the paper contained in the high capacity paper feeder 400 is supplied to the secondary transcription position via the third paper conveying path 83 and the first paper conveying path 81.

Further still, installed to the paper supply section 130 so as to extend in vertical direction is a fourth paper conveying path 84 of which one end is open at a bottom face while the other end thereof joins the first paper conveying path 81 on the upstream side of the secondary transcription position. In a case where an annexable paper supply unit is further added under the paper supply section 130, the paper contained in the annexable paper supply unit is supplied to the secondary transcription position via the fourth paper conveying path 84 and the first paper conveying path 81. To the fourth paper conveying path 84, a conveyance roller 841 is installed.

In the vicinity of the upstream side of the secondary transcription position in the paper conveying direction, a resist roller 13 is disposed. The resist roller 13 starts rotating with a timing such that the head of the paper fed from the paper supply section 130 coincides with the head of the developer image formed on the surface of the intermediate transcription belt 61, and then supplies the paper to the secondary transcription position.

When the paper supplied from the paper supply section 130 passes the secondary transcription position, a high voltage transcription voltage of the reverse polarity (e.g., plus) to the electrostatic charge polarity (e.g., minus) of the toner is applied to the secondary transcription roller 66. Thereby, a secondary transcription of the developer image is carried out from the outer circumferential surface of the intermediate transcription belt 61 onto the paper.

The developer remaining on the intermediate transcription belt 61 after the developer image has been transcribed onto the paper is collected by a cleaning unit 65 for the intermediate transcription belt.

The fuser 7 includes a heating roller 71 and a pressing roller 72. The paper onto which the developer image has been transcribed is led to the fuser 7, and then heated and pressed while passing between the heating roller 71 and the pressing roller 72. Thereby, the developer image is fixed firmly on a surface of the paper. The paper on which the developer image has been fixed is discharged onto the paper discharge tray 67 with the face on which the developer image has been fixed facing down.

In the vicinity of the fuser 7 in a housing of the image forming section 120, an exhaust section is provided; and an exhaust fan 14 is installed so as to exhaust from the exhaust section. The exhaust fan 14 constitutes an exhaust section for the image forming section 120 that exhausts the gas around the image forming stations 51-54 and the fuser 7 to outside of the image forming apparatus. Although in this embodiment the exhaust fan 14 is installed on one side face of the image forming section 120 that is nearer to the position where the fuser 7 is disposed, it may otherwise be installed on the rear face of the image forming section 120.

The image reading section 110, the image forming section 120, the paper supply section 130 and the ion generating unit 300 are electrically connected at the rear face, and electric power to the respective sections of the image forming apparatus is supplied by a power supply unit which is not illustrated.

The image reading section 110, the image forming section 120, the paper supply section 130 and the housing member 200 give a substantially identical shape with each other in plane view.

The housing member 200 is disposed at least below the image forming section 120. In this embodiment, the housing member 200 is disposed below the image forming section 120 and the paper supply section 130.

Since the housing member 200 is disposed below the image forming section 120 and gives substantially the same shape as the image forming section 120 and the paper supply section 130 in plane view, the housing member 200 does not protrude outward compared with the image forming section 120 and the paper supply section 130. Therefore, the floor space required for installing the housing member 200 does not increase.

Here, a space on one side face side of the image forming section 120 is used for disposing a post-processing device to perform sorting or the like of the paper that has undergone an image forming process, for opening a part of the apparatus to remove jammed paper, for disposing a discharge tray, for disposing a hand-fed paper tray, and for disposing a high capacity paper feeder 400 and/or the like. A space on the front face side of the image forming section 120 is used for refilling the toner, replacing a used up toner bottle and/or the like. As the rear face of the image forming section 120 is most often positioned along a wall face of the room where the image forming apparatus 10 is installed, if a unit such as the housing member 200 is disposed on the rear side, it follows that the image forming section 120 protrudes much to the wall face; and this makes an effective utilization of space difficult. Upside of the image forming section 120 is used for receiving a document.

In the image forming apparatus 10, since the housing member 200 is configured so as to give substantially the same shape as the image forming section 120 and the paper supply section 130 in plane view and is disposed below the image forming section 120, hindrance to disposing a post-processing device, hindrance to replacing a used up toner container and/or the like as described above is precluded.

The ion generating unit 300 is contained in the housing member 200. Since the ion generating unit 300 is disposed outside the image forming section 120, flexibility in designing both the image forming section 120 and the ion generating unit 300 increases.

The ion generating unit 300 is configured so as to ionize water vapor in the air by means of corona discharge in such a manner as to generate approximately equal amounts of positive ions and negative ions each other. In this embodiment, the positive ion is a hydrogen ion (H+) with a plurality of water molecules surrounding thereof, and is represented as H+(H2O) m (m denotes a natural number). On the other hand, the negative ion is an oxygen ion (O2−) with a plurality of water molecules surrounding thereof, and is represented as O2−(H2O) n (n denotes a natural number). The positive ions and/or negative ions, when they adhere to the surface of a bacterium floating around the image forming apparatus 10, chemically react and generate hydrogen peroxide H2O2 as an activated species or a hydroxyl group free radicals .OH. The hydrogen peroxide H2O2 or hydroxyl group free radicals .OH, by exhibiting an extremely strong activity, can sterilize bacteria floating in the air.

Figure 2:
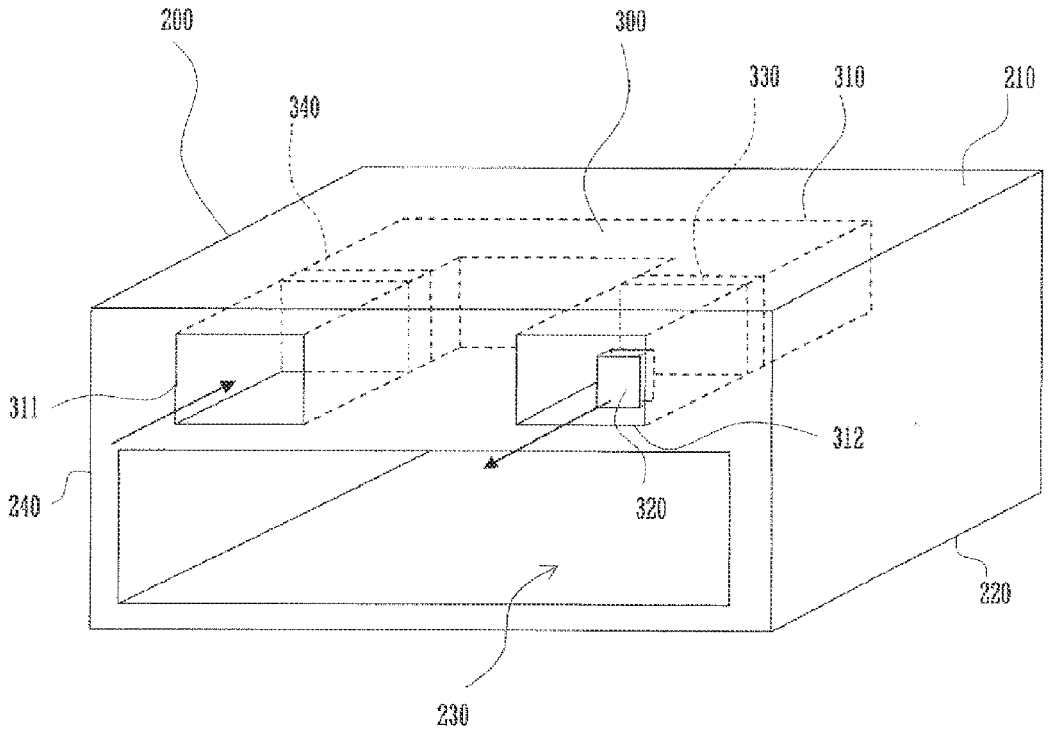
FIG. 2 is a perspective drawing showing an example of a housing member.

As shown in FIG. 2, the ion generating unit 300 includes a duct 310, an ion generating device 320, a fan 330 and a filter 340.

The duct 310 forms a pathway of flow to guide the air that is sucked in from outside of the housing member 200 again to outside of the housing member 200. As an example, both an air-intake side end 311 where suction of the air takes place in the duct 310 and an air-exhaust side end 312 where exhaust of the air takes place in the duct 310 have respective openings on the front face of the housing member 200.

It is preferred that the air-intake side end 311 has an opening on a face different from a face where the exhaust fan 14 is among outer faces of the image forming apparatus 10. The air-intake side end 311 is installed, for example, either on one side face of the image forming section 120 that is further away from the position where the fuser 7 is disposed, or on the front face of the image forming section 120. Because the exhaust fan 14 discharging the air out of the inside of the image forming section 120 and the air-intake side end 311 of the duct 310 are provided on respectively separate faces among the outer faces of the image forming apparatus 10, it is precluded that the air discharged from the exhaust fan 14 is sucked into the ion generating unit 300. Accordingly, it is prevented that the ion generating device 320 is subject to the influence of silicon or the like generated from the image forming section 120.

A filter 340 is provided in the vicinity of the air-intake side end 311 of the duct 310. The filter 340 is configured so as to capture dirt such as dust, toner, paper powder and the like that are about to enter into the duct 310. For the filter 340, although the one that has an ordinary function of capturing dust is acceptable as a general rule, employing such one that has a function of adsorbing silicon is preferred.

The fan 330 includes a driving source which is not illustrated, and is caused to rotate by the power supplied thereto. The fan 330 constitutes an air current generating section for generating an air current in the duct 310 from the air-intake side end 311 toward the air-exhaust side end 312. It is preferred that the fan 330 is disposed on the upstream side of the ion generating device 320 in the direction of the air current.

The ion generating device 320 is disposed in the duct 310. The ion generating device 320 is configured so as to ionize water vapor in the duct 310 by means of corona discharge in such a manner as to generate approximately equal amounts of positive ions and negative ions each other.

Because the ion generating device 320 is disposed in a space isolated from the space where the image forming stations 51-55 belongs to, it is prevented that the ion generating device 320 is subject to the influence of silicon or the like generated from the image forming stations 51-55. Accordingly, the ion generating unit 300 is capable of performing a stable generation of ions for an extended period of time.

In the ion generating unit 300 configured as described above, it is preferred that the duct 310 gives a shape extending along a plane.

As an example, the duct 310 gives a shape extending along a plane that is at right angles to a side face 240 of the housing member 200. The duct 310 can be configured so as to give a shape extending along a horizontal plane. It is preferred that the ion generating unit 300 is disposed along at least either the top face 210 or the bottom face 220 of the housing member 200. Because the duct 310 gives the shape extending along the horizontal plane, an overall shape of the ion generating unit 300 also gives a shape extending along the horizontal plane.

With the ion generating unit 300 being disposed adjacent to at least either the top face 210 or the bottom face 220 of the housing member 200, thinning of the housing member 200 can be achieved.

Besides, by making an inner dimension in height of the housing member 200 larger than an outer dimension in height of the ion generating unit 300, a storage section 230 large in horizontal directions is formed, either below the ion generating unit 300 when the ion generating unit 300 is disposed adjacent to the top face 210 of the housing member 200, or above the ion generating unit 300 when the ion generating unit 300 is disposed adjacent to the bottom face of the housing member 200. The housing member 200 is provided with an opening section that allows the storage section 230 to be opened to the front face side. Thereby, storage of large sized paper such as A3 size and/or the like in the storage section 230 is enabled.

In the image forming apparatus 10, the ion generating unit 300 is disposed adjacent to the top face 210 of the housing member 200, so that the storage section 230 is formed below the ion generating unit 300. Thereby, diffusion effect of the ions increases compared with the case in which the ion generating unit 300 is disposed adjacent to the bottom face 220.

The storage section 230 is adaptable to storage of maintenance parts for the image forming apparatus 10 as desired. As the maintenance parts, a toner cartridge to be attached to the image forming section 120, paper to be contained in the paper supply section 130, and/or a replacement filter for the ion generating unit 300, etc. are given. By storing the maintenance parts for the image forming section 120 and/or the ion generating unit 300, etc. in the housing member 200, a separate space for storing the maintenance parts becomes unnecessary. Moreover, since the maintenance parts are located in close proximity to the image forming section 120 and the ion generating unit 300, etc., workability on maintenance tasks increases.

Figure 3:
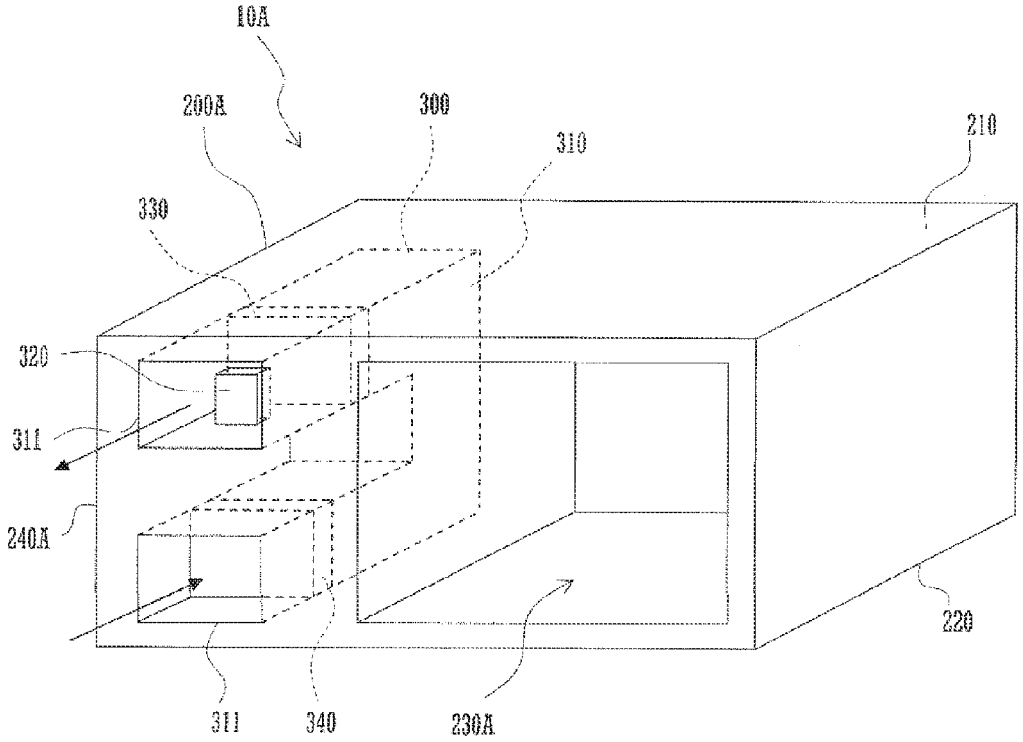
FIG. 3 is a perspective drawing showing another example of the housing member.

As shown in FIG. 3, with a duct 310 giving a shape extending along a vertical plane, disposing the ion generating unit 300 along one side face 240A of a housing member 200A is enabled. In an image forming apparatus 10A where the ion generating unit 300 is disposed in this manner, a storage section 230A is formed on one side of the ion generating unit 300. The storage section 230A has an opening on the front face side. A dimension in height of the storage section 230A is greater than that of the storage section 230 of the case where the ion generating unit 300 is disposed along either the top face 210 or the bottom face 220 in the housing member of the same height.

Accordingly, storage of the maintenance parts with a large dimension in height such as a toner cartridge, a large amount of paper and/or the like is enabled.

Figure 4A:
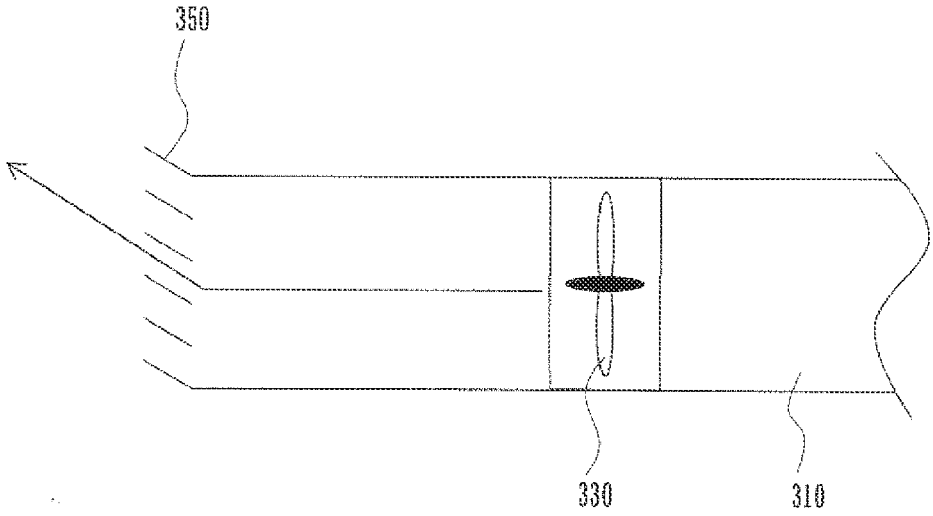
FIG. 4A is a partially enlarged drawing showing an example of a duct.
Figure 4B:
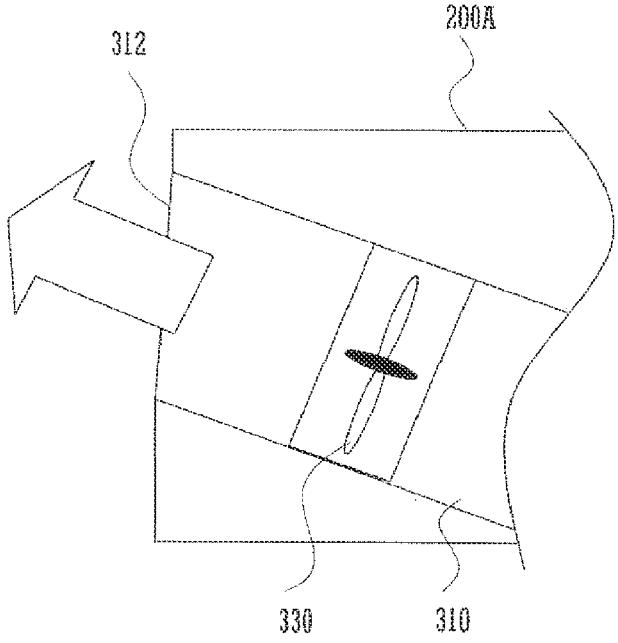
FIG. 4B is a partially enlarged drawing showing another example of the duct.

As shown in FIG. 4A and FIG. 4B, the air-exhaust side end 312 of the duct 310 may be configured so as to discharge the air to the front face side of the housing member 200A and upward relative to a horizontal direction. Thereby, the ions for air cleaning that the ion generating device have generated are blown off upward, and thus diffusion effect of the ions increases. As examples of configuring the upward exhaust relative to the horizontal direction, one in which an upward louver 350 is provided at the air-exhaust side end 312 as shown in FIG. 4A, and another in which a portion in the neighborhood of the air-exhaust side end 312 of the duct 310 is slanted upward relative to the horizontal direction as shown in FIG. 4B are given.

In addition, even in the case where the duct 310 gives the shape extending along the plane at right angles with the side face 240 of the housing member 200, it is possible to adopt the configuration in which the upward louver 350 is provided at the air-exhaust side end 312, or the configuration in which the ion generating unit 300 is disposed so that the front face side portion of the duct 310 is slanted upward relative to the rear face side portion thereof.

Figure 5:
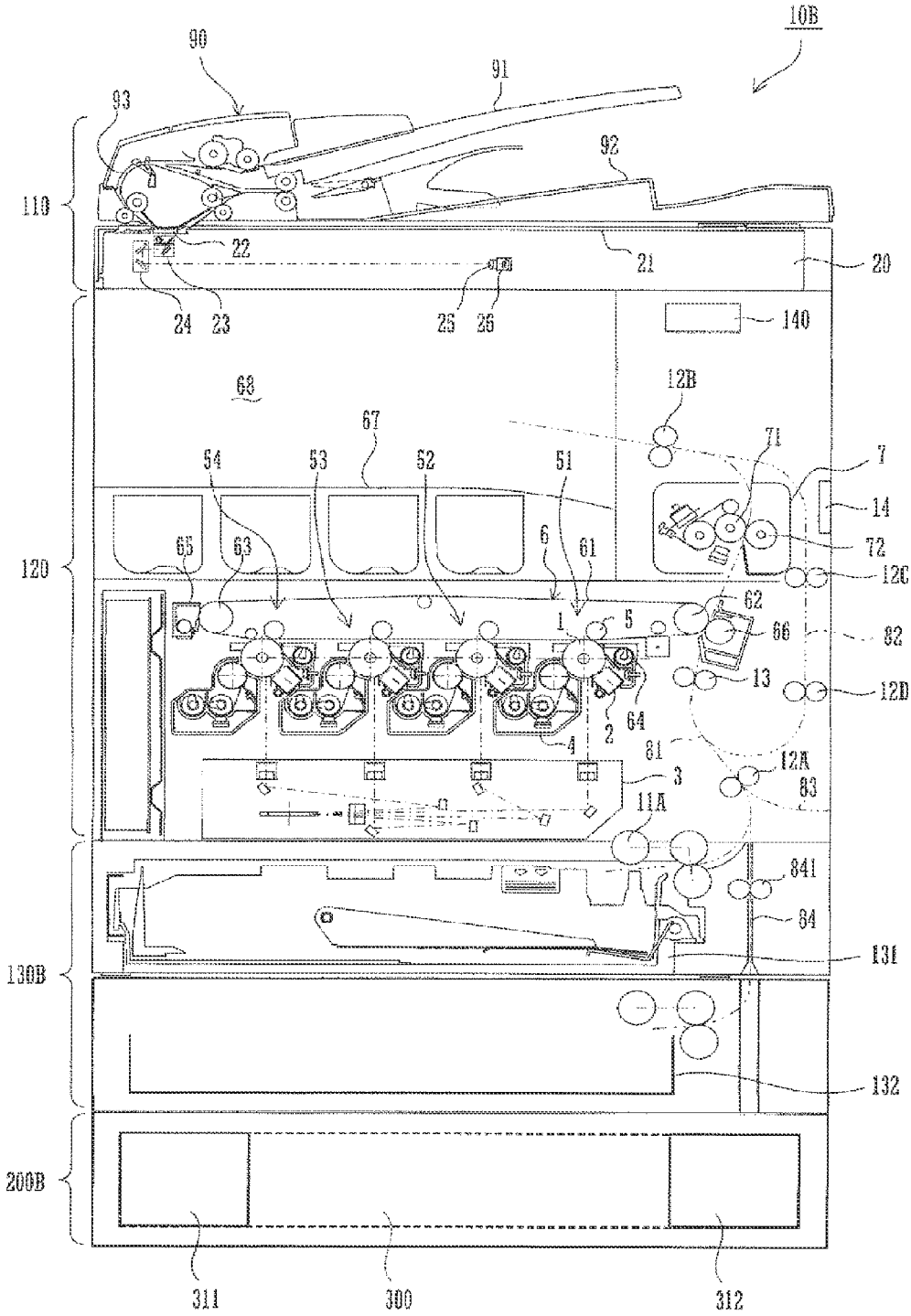
FIG. 5 is a drawing showing an outline of a configuration of an image forming apparatus according to another embodiment of the present invention.
Figure 6:
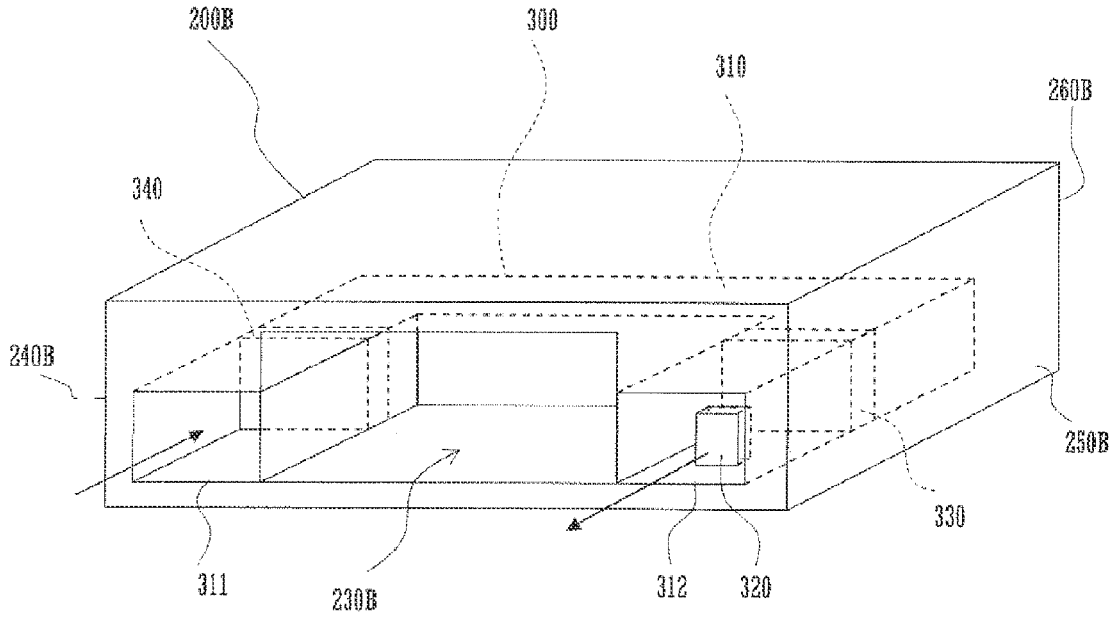
FIG. 6 is a perspective view of a housing member of the image forming apparatus according to the embodiment shown in FIG. 5.

As shown in FIG. 5, in an image forming apparatus 10B comprising a paper supply section 130B that is provided with a plurality of paper cassettes 131, 132 stacked in vertical direction, it is preferred that a storage section 230B is formed at an area surrounded by the duct 310 on three sides, as shown in FIG. 6. A housing member 200B is provided with an opening section that allows the storage section 230B to be opened to the front face side.

In the ion generating unit 300, in order to guide the air that is sucked in from the front face side of the housing member 200B again to the front face side, the duct 310 is configured so as to extend into a U-shape in plane view along one side face 240B, a rear face 260B, and the other side face 250B of the housing member 200B. Since the storage section 230B is formed at the area surrounded by the duct 310 on three sides, the storage of the maintenance parts is enabled without increasing the height of the housing member 200B.

Figure 7:
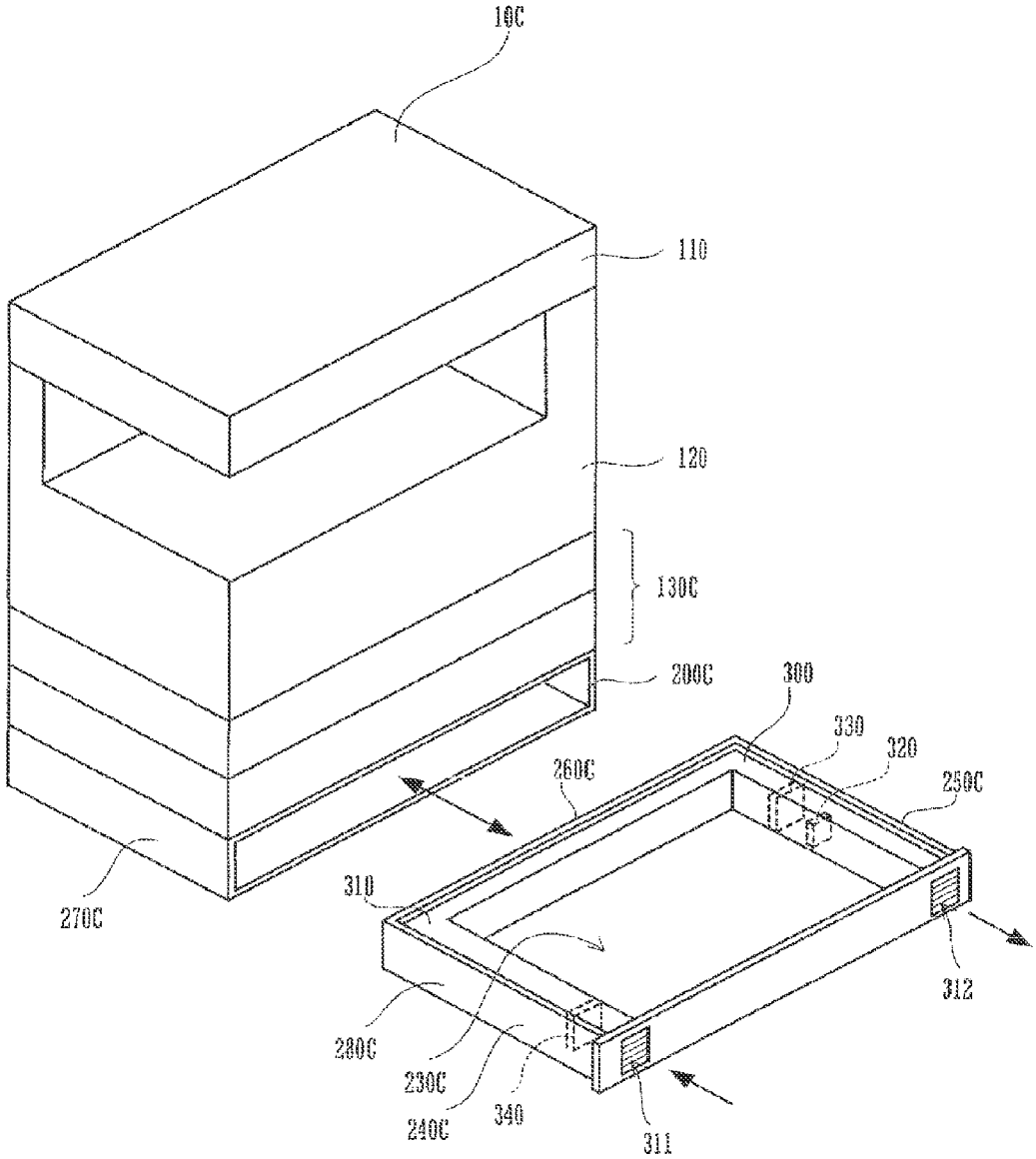
FIG. 7 is a perspective drawing showing an outline of a configuration of an image forming apparatus according to yet another embodiment of the present invention.

In the case where the paper supply section 130B is provided with a plurality of paper cassettes, the housing member 200B can be installed instead of one paper cassette. Because the housing member 200B can be made thinner than the paper cassette, height is held down also as the overall image forming apparatus 10B. As shown in FIG. 7, a housing member 200C may be configured so as to include a main body section 270C provided with an opening on a front face thereof, and a drawer section 280C received in the main body section 270C so as to be freely drawable to the front face side thereof.

In an image forming apparatus 10C comprising such a housing member 200C, the ion generating unit 300 is disposed inside the drawer section 280C. The drawer section 280C has a front face, a rear face 260C, two side faces 240C, 250C and a bottom face; and its top face is open.

In the ion generating unit 300, in order to guide the air that is sucked in from the front face side of the drawer section 280C again to the front face side, the duct 310 is configured so as to extend into a U-shape in plane view along one side face 240C, a rear face 260C, and the other side face 250C of the housing member 200C. At the area of which three sides are surrounded by the duct 310 inside the drawer section 280C, a storage section 230C is formed. With the ion generating unit 300 being disposed inside the drawer section 280C, upsizing the fan 330 is enabled, and thus resulting in blowing off the ions far. In the image forming apparatus 10C, pulling out the drawer section 280C makes it easy to carry out a maintenance task on the ion generating unit 300. Further, in a case where a paper supply section 130C is configured including a plurality of paper supply units each of which is provided with a frame of paper supply section and a paper cassette received in the frame of paper supply section so as to be drawn out freely therefrom, and where the drawer section is configured so as to be freely drawable and retractable in relation to the frame of paper supply section, the image forming apparatus 10C can easily be equipped with an ion generating function by installing the drawer section 280C inside the frame of paper supply section instead of the paper cassette, without replacing the frame of paper supply section. Thereby, cost reduction is attempted.

Figure 8:
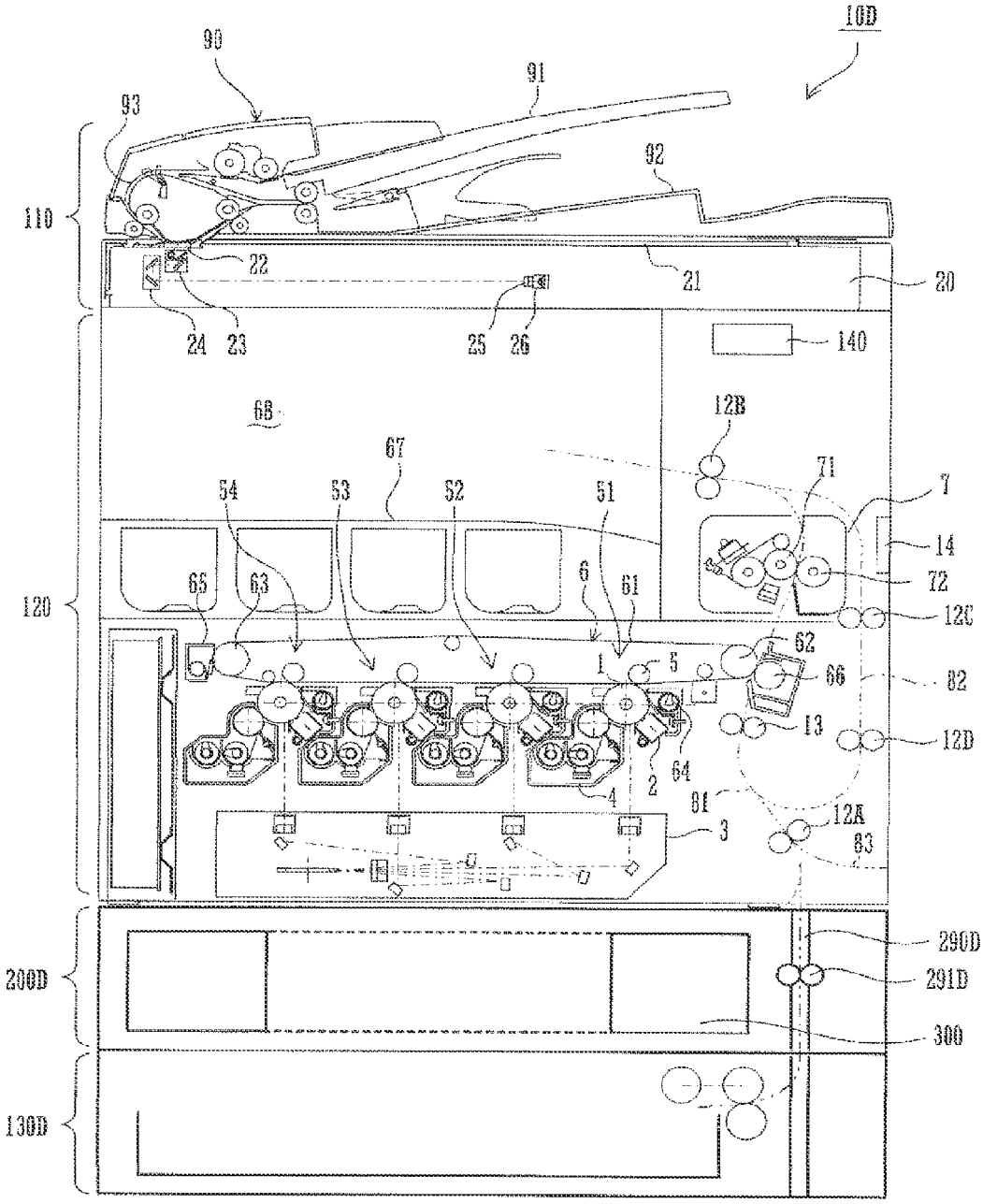
FIG. 8 is a drawing showing an outline of a configuration of an image forming apparatus according to still yet another embodiment of the present invention.

As shown in FIG. 8, a housing member 200D may be disposed between the image forming section 120 and a paper supply section 130D. In an image forming apparatus 10D where the housing member 200D is disposed between the image forming section 120 and the paper supply section 130D, the housing member 200D is provided with a guide section 290D for guiding the paper supplied from the paper supply section 130D to the image forming section 120. In the guide section 290D, a conveyance roller 291D is disposed; and the paper fed from the paper supply section 130D is conveyed to the secondary transcription position via the guide section 290D and the first paper conveying path 81.

With the image forming apparatus 10D, disposing the housing member 200D between the image forming section 120 and the paper supply section 130D, and then blowing off the ions from the position between the image forming section 120 and the paper supply section 130D are enabled. Blowing off the ions from a higher position causes the diffusion effect of the ions to increase further.

Additionally, the duct 310 of the ion generating unit 300 is not limited to be U-shaped, but may be configured so as to be L-shaped or rectilinear-shaped.

Figure 9:
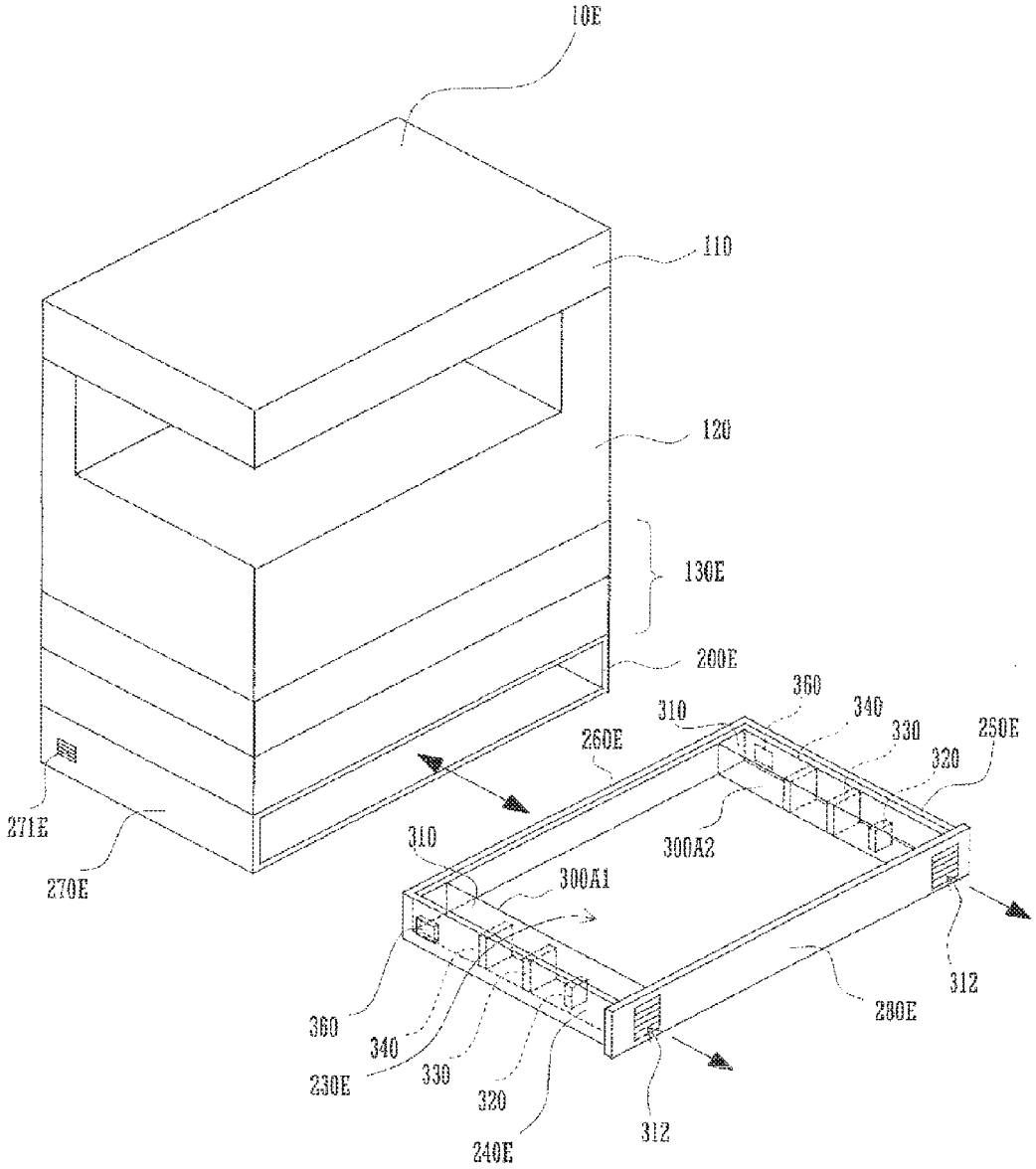
FIG. 9 is a perspective drawing showing an outline of a configuration of an image forming apparatus according to further still yet another embodiment of the present invention.
Figure 10:
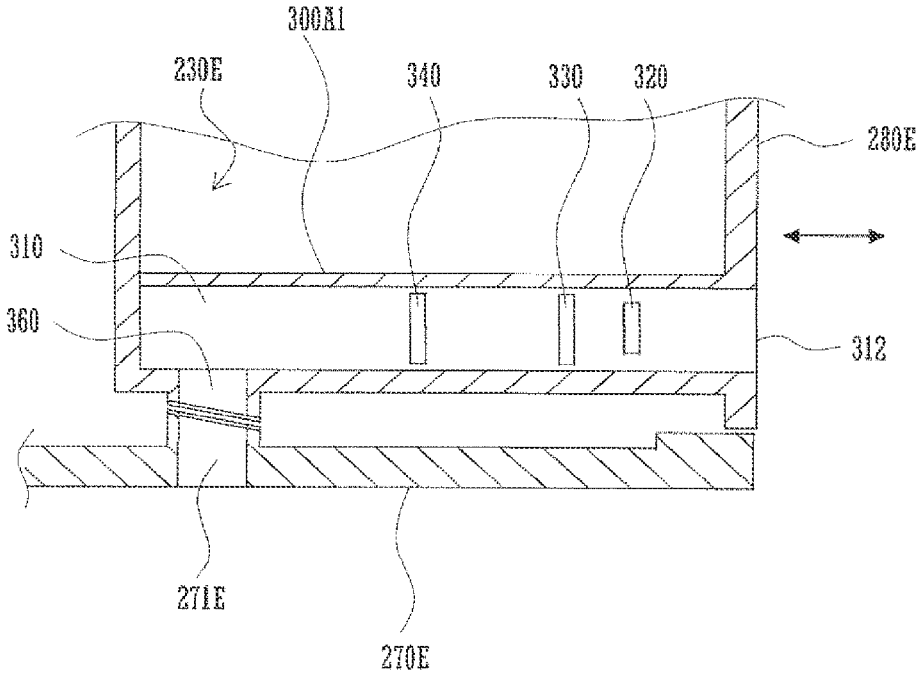
FIG. 10 is a plane sectional view of a part of a housing member of the image forming apparatus according to the embodiment shown in FIG. 9.

For instance, as shown in FIG. 9 and FIG. 10, a housing member 200E installed in an image forming apparatus 10E includes a main body section 270E provided with an opening on a front face, and a drawer section 280E received in the main body section 270E so as to be freely drawable to the front face side thereof.

Inside the drawer section 280E are disposed rectilinear-shaped ion generating units 300A1, 300A2. The drawer section 280E has a front face, a rear face 260E, two side faces 240E, 250E and a bottom face; and its top face is open.

In the ion generating units 300A1, 300A2, the duct 310 is formed in a rectilinear shape. The ion generating units 300A1, 300A2 are disposed so as to abut the respective side faces 240E, 250E of the drawer section 280E.

As an example, the side faces 240E, 250E of the drawer section 280E constitute respective one side faces of the ducts 310 of the ion generating units 300A1, 300A2.

The ion generating unit 300A2 is configured in the same manner as the ion generating unit 300A1.

The ion generating unit 300A1 is provided with an air-intake opening 360 on the side face 240E and at an end portion on the rear face 260 E side of the drawing section 280E. External air is sucked into inside of the duct 310 from the air-intake opening 360.

As an example, the air-intake opening 360 protrudes to the side. An edge face of the air-intake opening 360 is inclined in relation to the direction along the drawing direction in such a manner that its downstream side edge protrudes more than its upstream side edge in the direction of drawing the drawer section 280E.

Besides, the body section 270E includes an external air intake aperture 271E at a portion that faces the air-intake opening 360 when the drawer section 280E is in received state. The external air intake aperture 271E is provided on each of the side faces of the main body section 270E.

The external air intake aperture 271E protrudes inward. An edge face of the external air intake aperture 271E is inclined in relation to the direction along the drawing direction in such a manner that its upstream side edge protrudes more than its downstream side edge in the direction of drawing the drawer section 280E. Thereby, in a state where the drawer section 280E is received inside the main body section 270E, the edge face of the air-intake opening 360 and the edge face of the external air intake aperture 271E make a close contact, and thus communicate with each other. It is preferred that either the edge face of the air-intake opening 360 or the edge face of the external air intake aperture 271E is provided with a sealing member.

The ion generating unit 300A1 causes the air to be sucked in from the external air intake aperture 271E, to pass through the air-intake opening 360 and the duct 310, and then to be blown off from the air-exhaust side end 312.

Alternatively, by adopting a configuration in which the air-intake opening 360 has an opening on the rear face 260E of the drawer section 280E and the external air intake aperture 271E has an opening on the rear face of the main body section 270E, sucking the air into the duct 310 from the rear face side of the image forming apparatus 10E is enabled.

Furthermore, the housing member 200 may be configured in plane view: to be slightly larger; to be slightly smaller; and to have a partially different shape, compared to at least one of the image forming section 120 and the paper supply section 130. Even in these cases, hindrance to disposing a post-processing device, hindrance to replacing a used up toner container and/or the like as described above can be precluded.

The above explanation of the embodiments is nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. An image forming apparatus comprising:

an image forming section for performing an image forming process on paper;

a paper supply section for containing paper to be supplied to the image forming section; and a housing member disposed below the paper supply section and having a substantially same outer shape in plane view as the paper supply section, wherein the housing member includes:

a main body section provided with an opening on a front face; and a cleaning unit having an air cleaning function and being received in the main body section so as to be freely drawable to the front face side thereof.

2. The image forming apparatus as claimed in claim 1, wherein the cleaning unit includes an ion generating unit.

3. The image forming apparatus as claimed in claim 1, wherein the cleaning unit includes a filter.

4. The image forming apparatus as claimed in claim 1, wherein the cleaning unit includes an ion generating unit and a filter.

5. The image forming apparatus as claimed in claim 1, wherein the cleaning unit includes a duct forming a pathway of flow guiding air that is sucked in from outside of the housing member again to outside of the housing member, and an air-intake side end of the duct opens in the front face of the housing member.

6. The image forming apparatus as claimed in claim 5, wherein the cleaning unit further includes an air current generating section for generating an air current in the duct.

7. An image forming apparatus comprising:

an image forming section for performing an image forming process on paper;

a paper supply section for containing paper to be supplied to the image forming section; and a housing member disposed below the paper supply section and having a substantially same outer shape in plane view as the paper supply section, wherein the housing member includes:

a main body section provided with an opening on a front face;

a drawer section received in the main body section so as to be freely drawable to the front face side thereof; and a cleaning unit having an air cleaning function and being disposed inside the drawer section.

8. The image forming apparatus as claimed in claim 7, wherein the cleaning unit includes an ion generating unit.

9. The image forming apparatus as claimed in claim 7, wherein the cleaning unit includes a filter.

10. The image forming apparatus as claimed in claim 7, wherein the cleaning unit includes an ion generating unit and a filter.

11. The image forming apparatus as claimed in claim 7, wherein the cleaning unit includes a duct forming a pathway of flow guiding air that is sucked in from outside of the housing member again to outside of the housing member, and an air-intake side end of the duct opens in the front face of the housing member.

12. The image forming apparatus as claimed in claim 11, wherein the cleaning unit further includes an air current generating section for generating an air current in the duct.

* * * * *